United States Patent [19]

McVicker

[11] Patent Number: 4,625,616

[45] Date of Patent: Dec. 2, 1986

[54] THUMB PICK

[76] Inventor: Richard E. McVicker, 802 Northbend Rd., Beech Grove, Ind. 46107

[21] Appl. No.: 769,021

[22] Filed: Aug. 26, 1985

[51] Int. Cl.[4] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 756,348 | 4/1904 | Forney | 84/322 |
| 2,045,571 | 6/1936 | Dopyera | 84/322 |
| 3,112,668 | 12/1963 | Moshay | 84/322 |
| 3,595,118 | 7/1971 | Paxton | 84/322 |
| 3,699,838 | 10/1972 | Montgomery | 84/322 |
| 4,102,234 | 7/1978 | Brundage | 84/322 |

FOREIGN PATENT DOCUMENTS

| | | | |
|---|---|---|---|
| 11290 | of 1894 | United Kingdom | 84/322 |

*Primary Examiner*—Lawrence R. Franklin

[57] ABSTRACT

A thumb pick is provided for attachment to a musician's thumb. The thumb pick includes a string-engaging portion and an integral main body portion including straps for selectively defining a thumb-receiving passageway. The straps are movable between a substantially flat dormant position and a bowed thumb-receiving position. The string-engaging portion and the main body portion are substantially coplanar when the straps are in their dormant position. The string-engaging portion is positioned to extend transverse to the axis of the thumb and on a plane that is common to that axis.

9 Claims, 7 Drawing Figures

THUMB PICK

This invention relates to picks for stringed instruments, and particularly to picks attached to the musician's thumb for such instruments as banjos, dobros, pedal steels, and guitars, etc.

In the playing of these types of stringed instruments, combinations of finger and thumb picks are required for picking different strings separately and/or simultaneously. Therefore, each digit must have a rigidly attached pick having a string-engaging portion for contacting selected string or strings.

Ideally, each pick would include a soft, comfortable means for attachment to the thumb while providing a properly positioned string-engaging portion that is firm and rigid.

A conventional thumb pick 70 is illustrated in FIG. 1. The pick 70 includes loop portion 72 and a pick point 74. Thus, a substantially "P"-shaped strip of rigid plastic secured by the resilient loop portion 72 holds the cantilevered pick point in position for engaging the strings. These picks maintain their spring load throughout the life of the pick and cannot be worn for a great length of time since they often exert great pressure in the area of the cutical of the nail. Although this type of thumb pick requires constant compression, it must be of a thick rigid material since the pick point is cantilevered from the bottom center of the thumb.

Another major problem with this existing type of pick is that it tends to be unidirectional and only stays in its proper location when strings are stuck with a downward stroke of the thumb. Should the pick catch on a string or other object while the thumb is moving in an upward motion, the pick becomes misaligned and often comes off.

According to the present invention, a thumb pick is provided for attachment to a musician's thumb. The thumb pick includes a string-engaging portion and an integral main body portion including strap means for selectively defining a thumb-receiving passageway. The strap means is movable between a substantially flat dormant position and a bowed thumb-receiving position. The string-engaging portion and the main body portion are substantially coplanar when the strap means is in its dormant position. The string-engaging portion is positioned to extend transverse to the axis of the thumb and on a plane that is common to that axis.

The strap means further includes a top portion situated in spaced-apart relation to the string-engaging portion and at least three straps interconnecting the top portion and the string-engaging portion. The straps are independently movable in opposite directions to define the thumb-receiving passageway. Preferably, the straps are aligned in parallel relation.

The pick is formed from a thin sheet of material which is deformable by the thumb out of the plane of the material. The material is soft enough and heat plyable enough to allow the thumb shape and the body temperature to dictate the shape of the novel pick both in a plane common to and transverse to the axis of the thumb. Advantageously, the unique shape and structure of the pick permits the pick to be worn universally by right- or left-handed musicians by merely turning over the pick and reversing the strap means. Further, the pick point of the novel pick is more visible to the player of the dobros or pedal steel guitar and instruments which are played in a plane transverse to the body of the musician. The visibility is increased because the pick point is located at the midpoint of the thumb, instead of from a point tangent to the bottom of the thumb.

The novel strap means advantageously permits the musician to stroke the strings on the up-stroke or return stroke without the pick being displaced from the thumb, thereby increasing the number of times the pick can contact a string per stroke of the thumb. This also provides an add sequence of notes which can be obtained in a single stroke.

Another feature is the ability of the material to return to a flat plane after being removed from the musician's thumb to allow the pick to be stored in a substantially flat condition in a holder, wallet, or pocket. Still another feature allows the pick to convert to a flat state for use as a conventional guitar pick to be held between the thumb and first finger.

Advantageously, the pick point of the novel pick is bowed in tension to add strength to the pick point against bending while contacting the strings and simultaneously allowing the strap portions of the pick to be soft and malleable in a plane transverse to the bowed condition of the pick point. Advantageously, the strap means contacts the entire circumferential surface of the thumb. A window is defined by the straps for embracing the fleshy portion of the thumb to resist axial removal of the pick. One side of the thumb will experience approximately twice the surface contact of the pick as does the other side of the thumb. The wearer of the novel pick is able to trim or reshape, with scissors, the string-engaging point of the pick.

Additional features and advantages of the present invention will become apparent to those skilled in the art upon consideration of the following description related to the preferred and modified emobdiments illustrated in the drawings.

Figure 1:
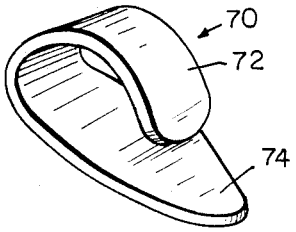
PRIOR ART FIG. 1
FIG. 1 is an illustration of the prior art.

Referring now to FIGS. 2–6, the pick 10 includes a main body portion 12, a pick point or string-engaging portion 14, and a strap connector or top portion 16. Desirably, the pick 10 is formed from a plastics material such as polyurethane or polypropylene. Advantageously, the pick 10 is firm on the strings yet comfortably conforms to the specific thumb shape of each musician since it is made using soft plastics material and is configured in the novel manner described below.

Two spaced-apart parallel slits 18 and 20 are formed in the pick 10 extending between the pick point 14 and the strap connector 16. These two slits 18, 20 penetrate completely through the pick 10. The slits 18 and 20 define a plurality of straps interconnecting the pick point 14 and the strap connector 16. Thus, the pick 10 further includes a top strap 22, bottom strap 26, and a middle strap 24.

Figure 2:
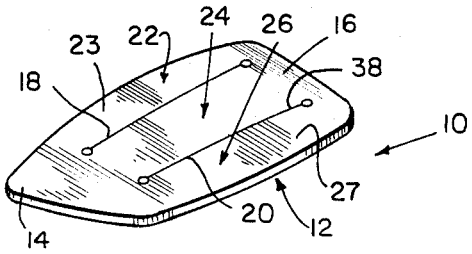
FIG. 2 is a perspective of the preferred embodiment in an unused state.

The main body portion 12 lies substantially flat when in its dormant position as illustrated in FIG. 2. The pick is dormant when not in position on one of the musician's fingers. Advantageously, the novel pick 10 of the present invention is easily expanded into an operating position, an example of which is shown in FIGS. 3–6, by manipulating the relative position of the three straps 22, 24, and 26 as described in the following paragraphs.

Figure 3:
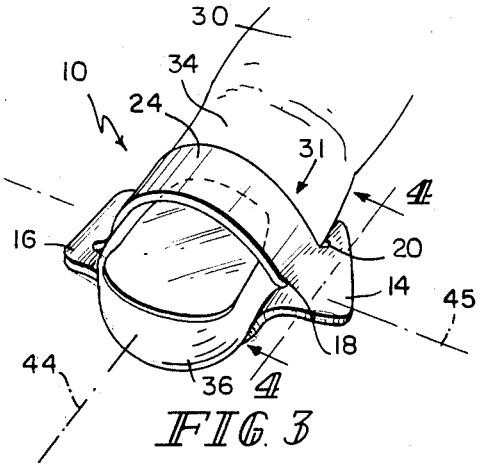
FIG. 3 is a perspective view of the present invention illustrating the pick as positioned for use on the thumb of a musician.
Figure 4:
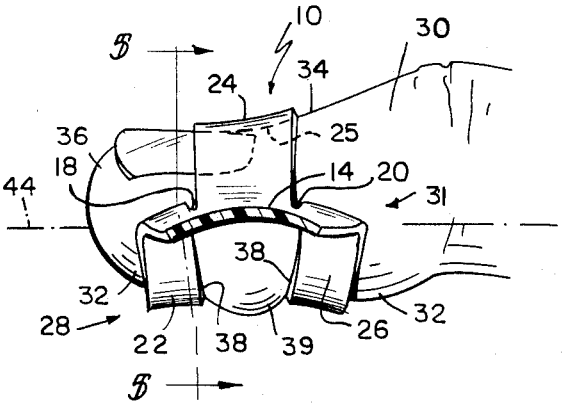
FIG. 4 is an enlarged transverse sectional view on lines 4—4 of FIG. 3.
Figure 5:
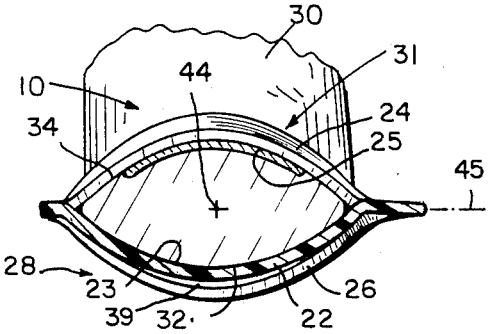
FIG. 5 is a section taken along lines 5—5 of FIG. 4.
Figure 6:
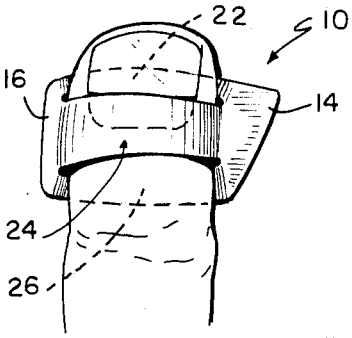
FIG. 6 is a top plan view of the pick position on a left-handed musician.

Attachment of the pick 10 to the right thumb of a musician or other user is accomplished by inserting the distal end 36 of the thumb 30 into the slit 20 and under the middle strap 24 continuing until the distal end 36 of the thumb 30 passes through the other slit 18, and over the top surface 23 of the strap 22 to a position as illustrated in FIG. 3. The middle strap 24 is bowed as the musician's thumb is guided along a path weaving through the three straps 22, 24, and 26. A top surface 23 of the top strap 22 and a top surface 27 of the bottom strap 26 cooperate to embrace the musician's thumb 30 by snugly engaging underside 32 of the thumb 30. At the same time, a bottom surface 25 of the middle strap 24 embraces the top side 34 of the thumb 30. As can be seen in FIGS. 3, 4, and 5, straps 22, 24, and 26, pick point 14, and strap connector 16 cooperate together to provide a thumb-securing means 31.

Although it is preferred that the pick 10 be worn with the middle strap 24 engaging the top side 34 of the thumb 30 and the straps 22 and 26 engaging the underside 32 of the thumb 30, it should be understood that the pick 10 can be worn alternatively with the straps inverted so that the pair of straps 22 and 26 engage the top side 34 of the thumb 30 and the strap 24 engages underside 32 of the thumb 30. This feature advantageously permits the musician to wear the pick 10 in a variety of positions by changing the direction of the bow of the middle strap 24 from the position shown in FIGS. 3–6 to an oppositely bowed position. The bottom surface 25 of the middle strap 24 is presented away from the musician's thumb when the pick 10 is worn instead of engaged to the top side 34 of the thumb as shown best in FIG. 5. This invertable feature permits a musician to manipulate the middle strap 24 to one of two oppositelv bowed positions prior to weaving his thumb through the pick straps 22, 24, and 26, thereby to position the straps to protect a deformed, damaged, or blistered thumb. In either bowed position, the pick point 14 can be oriented toward its proper picking position.

It will be appreciated that the middle strap 24 can be bowed in a direction opposite to either of the directions described above to permit the pick 10 to be worn on the left thumb instead of the right thumb. Thus, the pick point 14 can be oriented toward its proper picking position when the pick 10 is worn on the left thumb in either bowed position.

The pair of straps 22 and 26, as seen in FIG. 4, cooperate with pick point 14 and strap connector 16 to form a window 38 for receiving and embracing a fleshy portion 39 of thumb 30. The collecting of tissue in this area tends to provide a means for resisting removal of the pick 10 from the thumb 30 along an axis 44 of thumb 30.

Straps 22 and 26 also cooperate with the middle strap 24 at the connection to pick point 14 to load the pick point 14, as seen in FIG. 4, in a bowed condition transverse to the curvature of the straps 22, 24, and 26 while worn by the musician. This is accomplished by the strap 22 and strap 26 exerting a downward force to the outer edges of the pick point 14 while the middle strap 22 exerts an upward force to the center of the pick point 14.

FIG. 4 also illustrates the location of the middle strap surface 25 over the end of the thumb nail and cutical area and being curved in a concave condition. Straps 22 and 26, respectively, are displaced by the underside 32 of the thumb 30 in a convex curvature. These convex and concave conditions are a result of the flexibility of the strap material and the malleability of the material by way of the body temperature of the musician.

As seen in FIG. 5, it can be appreciated that continuous contact is made with the entire circumference of the thumb 30 by way of the strap 22 and the pair of straps 24 and 26.

The location of the pick point 14 relative to the axis 44 of the thumb 30 is located on a line 45 common with the axis 44. This is different than prior art FIG. 1 in that the pick point is cantilevered from the "C"-shaped portion of the pick with the last point of contact with the thumb being about the middle of the underside of the fleshy portion of the thumb. This requires a hard and thick material that will not deflect over a length of approximately $\frac{3}{4}$ inch.

FIG. 5 illustrates the location of the pick point on the axis 44 of thumb 30 and having a length of approximately $\frac{3}{8}$ inch. The pick point is also located adjacent the edge of the thumb nail in a much more rigid location away from the fleshy portion 39 of the thumb.

Figure 7:
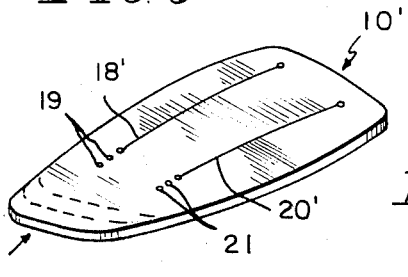
FIG. 7 is a perspective view of a universal size thumb pick.

FIG. 7 shows a modification of the pick 10' wherein the length of the slits 18' and 20' can be extended into holes 19 and 21 to fit larger thumbs with a larger pick point 14' to be trimmed to desired shape and length as indicated in dotted lines.

Although the thumb pick herein described can be molded with areas of various thicknesses, it has been found that the illustrated embodiment can be formed from a substantially plane/sheet of material such as polyethylene, nylon, metal, etc., and of a thickness approximately one-half of prior picks and still maintaining a constant stiffness at the pick point 14.

Although the invention has been described in detail with reference to certain preferred embodiments and specific examples, variations and modifications exist within the scope and spirit of the invention as described and defined in the following claims.

What is claimed is:

1. A pick for stringed instruments, the pick comprising:

a string-engaging portion, and an integral main body portion including strap means for selectively defining a thumb-receiving passageway, the strap means being movable between a substantially flat dormant position and a bowed thumb-receiving position, said strap means including a top portion and at least three straps interconnecting the top portion and the string-engaging portion.

2. The pick of claim 1, wherein the string-engaging portion and the main body portion are substantially coplanar when the strap means is in its dormant position.

3. The pick of claim 1, wherein the at least three straps are aligned in parallel relation.

4. The pick of claim 1, wherein the straps are independently movable in opposite directions to define the thumb-receiving passageway.

5. A pick for stringed instruments, comprising:

a top portion, a string engaging portion, and at least three straps interconnecting the top portion and the string-engaging portion, the straps being alternately deflectable in opposite directions to define a passageway for receiving a user's thumb so that the thumb can independently wear the pick while said string-engaging portion engages the strings of a string instrument.

6. The pick of claim 5, wherein the at least three straps are aligned in parallel relation.

7. The pick of claim 5, wherein the straps are independently movable in opposite directions to define the thumb-receiving passageway.

8. A pick for playing a stringed instrument, the pick comprising a main body portion formed to include a string engaging portion, spaced-apart parallel slits cooperating to define a top strap, a middle strap, and a bottom strap, the top and bottom straps being selectively movable in a first direction to embrace the fleshy part of a thumb inserted into the thumb-receiving passageway and the middle strap being selectively movable in a second opposite direction to embrace the thumb nail.

9. The pick of claim 8, wherein the top and bottom straps are selectively movable in the second direction to embrace the thumbnail and the middle strap is selectively movable in the first direction to embrace the fleshy part of the thumb.

* * * * *